United States Patent [19]

Golda et al.

[11] 4,148,649

[45] Apr. 10, 1979

[54] METHOD FOR PRODUCING LITHOGRAPHIC PRINTING PLATES

[75] Inventors: Eugene Golda, Monsey; Alan L. Wilkes, Brewster; Simon L. Chu, Dobbs Ferry, all of N.Y.

[73] Assignee: Polychrome Corporation, Yonkers, N.Y.

[21] Appl. No.: 767,017

[22] Filed: Feb. 9, 1977

[51] Int. Cl.[2] ..... G03C 1/52; G03C 1/64; G03C 1/66

[52] U.S. Cl. ..... 96/75; 96/33; 96/67; 427/327; 427/372 R; 427/372 A; 427/372 B; 427/399; 428/450; 428/913; 101/456

[58] Field of Search ..... 427/318, 327, 331, 372 R, 427/372 A, 372 B, 384, 399, 402, 435; 428/457, 469, 913, 450; 96/33, 75, 67; 101/456

[56] References Cited

U.S. PATENT DOCUMENTS

| | | | |
|---|---|---|---|
| 2,186,946 | 1/1940 | Wood | 427/399 |
| 2,321,732 | 6/1943 | Brant | 428/450 |
| 2,681,310 | 6/1954 | Wood | 427/399 |
| 2,694,020 | 11/1954 | Tovee et al. | 428/450 |
| 2,714,066 | 7/1955 | Jewett et al. | 96/75 |
| 2,922,715 | 1/1960 | Gumbinner | 96/33 |
| 2,946,683 | 7/1960 | Mellar et al. | 96/33 |
| 3,136,636 | 6/1964 | Dowdall et al. | 96/33 |
| 3,160,506 | 12/1964 | O'Connor et al. | 96/33 |
| 3,261,285 | 7/1966 | Sorkin | 427/384 |
| 3,940,321 | 2/1976 | Adams | 96/33 |

*Primary Examiner*—Michael F. Esposito
*Assistant Examiner*—Sadie L. Childs

[57] ABSTRACT

A method for producing an improved aluminum substrate for lithographic printing plates which comprises applying an interlayer bonding solution to the surface of an aluminum web, heating said interlayer solution on the surface of the said aluminum at an elevated temperature and removing any excess solution which has not reacted with the aluminum substrate.

16 Claims, No Drawings

METHOD FOR PRODUCING LITHOGRAPHIC PRINTING PLATES

BACKGROUND OF THE INVENTION

This invention relates to a method for producing metal lithographic printing plates. More particularly, this invention relates to a novel method for producing an improved metal substrate useful in the production of metal, presensitized lithographic printing plates. Even more particularly, this invention relates to a novel method for the production of an improved aluminum sheet substrate useful in the production of aluminum, presensitized lithographic printing plates.

Heretofore, in the production of metal presensitized lithographic printing plates, it had been found beneficial to treat the surface of the metal substrate sheet, with a protective interlayer substance which imparts beneficial characteristics to the final lithographic printing plate thus produced. The prior art teaches that it is desirable to treat the metal sheet substrate surface receiving the light sensitive coating material, which when exposed to light and developed becomes the printing surface of the printing plate, with an undercoating substance that forms a strong bond with the metal sheet substrate and with the light sensitive coating material.

Many such undercoating treatments are known in the art for manufacturing longer-running lithographic plates, and can be used on the sheets of this invention. U.S. Pat. Nos. 3,160,506, 3,136,636, 2,946,683, 2,922,715 and 2,714,066 disclose a variety of suitable materials for undercoating bonding substances onto plates and methods for applying them. Alkali silicate, silicic acid, alkali zirconium fluoride and hydrofluozirconic acid solutions presently are the most important commercial bonding substances. Those materials substantially improve the bonding of the light-sensitive coating to the underlying metallic base which otherwise generally tends to have inadequate affinity for the coating. Of the various known bonding materials, the Group IV-B metal fluorides, the alkali metal salts and the acids thereof are preferred. In particular, the alkali zirconium fluorides, such as potassium zirconium hexafluoride, and hydrofluozirconic acid disclosed in U.S. Pat. Nos. 3,160,506 and 2,946,683 are especially satisfactory for preparing anodized aluminum bases to receive a light-sensitive coating.

The undercoating substance is usually applied to the metal sheet substrate by immersing the sheet in a solution of the bonding substance. This requires that an immersion tank be employed, and depending upon the rate of speed of the moving web of the metal substrate, the length of detention time within the immersion tank can be varied. However, it is recognized that an immersion tank of substantial size is required to obtain a satisfactory treatment with the bonding substance in prior art practice. By the instant invention it has been found that the need for an immersion tank can be eliminated, thus producing a concomitant reduction in the amount of energy required to obtain equivalent or superior results than heretofore possible in prior art processes.

In general, the instant invention comprises a method whereby the undercoating substance is applied solely to and directly on the surface of the metal sheet substrate which is employed for use as a lithographic printing plate. More particularly, a solution of the undercoating substance is applied to the surface of the metal sheet substrate in sufficient concentration to provide for complete reaction with the surface to give a satisfactory bonding coating to the metal sheet substrate. The thus applied solution is then subjected to a heating treatment at elevated temperature whereby the surface of the metal sheet substrate is brought quickly to dryness. This treatment concurrently increases the concentration of the bonding substance on the surface of the metal sheet substrate to a satisfactory level and rapidly brings the reaction between the solution and substrate material to completion and forms a novel coated substrate with markedly improved properties. The surface may then be treated to remove excess unreacted materials, and the resultant metal sheet substrate may then be further treated in various manners known to the art to produce presensitized lithographic printing plates.

PRIOR ART

As previously mentioned, a number of undercoating or interlayer treatments are known in the art but these differ materially from the present invention.

U.S. Pat. No. 3,160,506 issued to O'Conner and Chu discloses a method for preparing planographic printing plates employing a wide choice of interlayer compositions, however it does not teach the step of baking the interlayer composition once applied to the substrate as revealed in the present application.

Similarly U.S. Pat. No. 2,922,715 issued to Gumbinner, and U.S. Pat. No. 2,946,683 issued to Mellan and Gumbinner teach hardening the interlayer surface with an organic acid such as citric acid or tartaric acid, but no baking operation.

U.S. Pat. No. 3,136,636 issued to Dowdall and Case reveal a polyacid organic intermediate layer, but again, no baking is performed.

U.S. Pat. No. 2,714,066 issued to Jewett and Case divulge a drying or simple water elimination from a silicate solution on a foil, but no baking of the interlayer to bring the reaction quickly to completion.

Although many other prior art disclosures do not show the inclusion of an interlayer, plates manufactured according to these specifications demonstrate an inadequate adhesion of the photosensitive material to the base substrate and are unsatisfactory for long press runs. The desirability of such an interlayer for improved bonding and protection of the base is well known to the art.

The present invention substantially improves the bonding and protecting performance of these interlayers resulting in a concurrent increase in plate life with a significant decrease in capital equipment required to manufacture these plates.

SUMMARY OF THE INVENTION

Heretofore, it has been necessary to treat the surface of the metal sheet substrate with a bonding coating for a minimum of fifteen seconds up to several minutes duration to adequately prepare a lithographic substrate to accept a light sensitive coating. The present invention provides a substrate having improved properties which substrate is obtained with a shortened treatment time by a method comprising the steps of applying the bonding coating material to the desired metal sheet substrate, thereafter removing any excess coating material followed quickly by baking the coated sheet at elevated temperatures, and removing any unreacted chemical bonding substance. As a result, there is a considerable reduction in the amount of production time, energy and capital equipment required for producing a sheet of coated metal substrate suitable for use as a base for a lithographic printing plate.

It is therefore an object of the present invention to provide an improved method for treating a metal sheet substrate suitable for use as a base for a lithographic plate with a bonding coating whereby the treatment time is significantly reduced.

It is a further object of the present invention to provide an improved method for treating a metal sheet substrate suitable for use as a base for a lithographic plate with a bonding coating which substantially reduces the capital equipment required for the manufacture thereof.

It is another object of the present invention to provide an improved method for treating a metal sheet substrate suitable for use as a base for a lithographic plate with a bonding coating whereby the reaction between the metal sheet substrate and the coating solution is brought quickly to completion thus producing an improved surface with more stable characteristics.

DETAILED DESCRIPTION OF THE PREFERRED EMBODIMENT

As the first step in the process of this invention, a sheet metal substrate, preferably aluminum and the alloys thereof especially those aluminum compositions suitable for the manufacture of lithographic printing plates such as Alcoa 3003 and Alcoa 1100 which may or may not have been pre-treated by standard graining and/or etching and/or anodizing techniques as are well known in the art, is coated by spraying, brushing, dipping or other means with a composition suitable for use as an interlayer for lithographic plates. Standard metal substrate pretreatments include electrolytically anodizing in sulfuric, chromic, hydrochloric and/or phosphoric acids, electrolytically etching in hydrochloric or phosphoric acid, and chemical or mechanical graining by well known methods, which are all known to the skilled worker. Coating compositions employable in the practice of this invention include aqueous solutions of alkali silicate, silicic acid, the Group IV-B metal fluorides, the alkali metal salts or the acids thereof, polyacrylic acid, the alkali zirconium fluorides, such as potassium zirconium hexafluoride, or hydrofluozirconic acid in concentrations of 0.5% to 20% by volume. A preferred concentration range is from 3% to 8% and the most preferred range is from 4% to 5%.

Excess solution is then removed, from the surface of the metal substrate, for example by doctoring, and the resulting coated plate is then subjected to elevated temperatures, for example, by baking in an oven, typically from 50 degrees C. to 300 degrees C. for from 5 to 120 seconds, whereby a completely reacted coating layer is formed.

A preferred elevated temperature treatment range is from 80 degrees C. to 200 degrees C. and the most preferred elevated temperature range is from 100 degrees C. to 150 degrees C. It is preferred to subject the coated substrate to the elevated temperatures for a period of from 10 to 45 seconds and most preferred from 15 to 20 seconds. Subsequently, the surface may be treated for example, by rinsing with water to remove any excess unreacted materials. The resulting coated metal sheet substrate may then be treated with a photosensitive composition suitable for use as a lithographic printing plate, such as a positive or negative acting diazo composition, for example, paradiazo diphenolamine condensed with formaldehyde and optionally mixed with ink receptive polymers suitable to produce a presensitized lithographic printing plate, as is well known in the art.

The superior results obtained from the practice of the instant invention is evidenced by a comparison of the treated interlayer coating of the instant invention with a substrate coating obtained by using standard techniques disclosed in the prior art. To this end a standard zincate test as described in U.S. Pat. No. 3,940,321 at column 3 line 36, et seq. is performed on each type surface. The zincate test is a measure of the protection which the interlayer affords the base substrate from extraneous eroding compounds and is a measure of the completeness of the reaction between the coating solution and the substrate. Such comparative testing consistently shows a marked superiority in protection and stability of the substrate of the instant invention obtained by a subsequent baking of an applied interlayer at elevated temperatures as compared to substrates prepared by standard techniques used in the art.

Compositions which are generally employed as interlayers in lithographic plates actually are not completely untainted materials. A variety of impurities are present in the substances employed for such purposes, which either prevent or delay the consummation of the reaction between the intended interlayer material and the metal sheet substrate. This causes an instability and unpredictability in the finished product since the intended reaction does not go to completion under controlled conditions. For example, a lithographically suitable aluminum plate which has been anodized with an aluminum oxide sub-stratum may be further coated with a protective silicate bonding layer by the equation, $$Al + 3AlO_2 + 2\ SiO_2 \rightarrow 2(Al_2SiO_5)$$

However, there are other compounds present in the interlayer film such as, aluminum hydroxide, $Al(OH)_3$ and hydrated sodium aluminum silicates such as, $Na_2O\ Al_2O_3\ 2SiO_2\ 6H_2$ which delay or prevent the completion of the above reaction under normal conditions. Periodic zincate tests conducted on a sample lithographic plate prepared in accordance with this invention over an extended interval of time produced consistent zincate readings whereas a similar test on a substrate coated by prior art techniques, produced increasing readings indicating a gradual rather than instantaneous completion of the reaction over time. The method of this invention drives the above reaction to completion immediately and forces the removal of the impurities by the intended interlayer reactant, thus yielding a final product of improved storage stability and quality.

As a result, it has been found that on the average, lithographic plates made in accordance with the present invention display a 33⅓% to 50% increase in shelf life and a 20% to 33⅓% increase in press life, with a marked improvement in the tenacity between the interlayer and the photosensitive coating.

The following examples are provided to illustrate the operation of the present invention and in no way limits its scope.

EXAMPLE 1

Two sets of mechanically grained aluminum sheets were anodized by use of direct current in a sulfuric acid solution by a method well known in the art. The plates were then treated as follows:

A series of aluminum plates "A" to be treated by the method of this invention were spray coated with a 4% aqueous sodium silicate solution at room temperature, excess was doctored off and the plates then subjected to a hot air baking treatment at 120 degrees C. for 15 seconds. The plates were then rinsed to remove excess reactants and a light sensitive lithographic coating applied to the surface of each treated plate.

A series of aluminum plates "B" were dipped in a 5% sodium silicate solution which was maintained at 180 degrees F. for 2 minutes. The plates were then rinsed and a light sensitive lithographic coating applied to the surface of each treated plate.

Each plate was exposed to accelerated shelf life testing which showed plates made according to treatment A of the instant invention to have consistent good image producing quality after a simulated 18 month shelf life whereas plates made according to treatment B demonstrated inconsistent image producing quality after a 12 month simulated shelf life. This test demonstrated that the "A" plates shelf life was superior to that of the "B" plates by at least 50%.

Plates A and B were imaged and developed according to well known methods and mounted on a printing press. Plate A showed first appearance of image wear after 180,000 impressions, whereas plate B showed first appearances of image wear after 150,000 impressions, indicating the improved characteristics of the "A" plates.

EXAMPLE 2

Treatments and tests were run similar to Example 1 except the sodium silicate was replaced by a 1% aqueous solution of potassium zirconium fluoride. Similar results were obtained.

EXAMPLE 3

Treatments and tests were run similar to Example 1 except the aluminum sheets were not anodized. Similar results were obtained.

EXAMPLE 4

Treatments and tests were run similar to Example 1 except the aluminum plates were chemically etched in a 5% solution of trisodium phosphate instead of mechanical graining. Similar results were obtained.

EXAMPLE 5

Treatments and tests were run similar to Example 1 except the sodium silicate concentration was 6.5% and the baking treatment of plate A was for 22 seconds at 100 degrees C. Similar results were obtained.

EXAMPLE 6

Two aluminum plates were spray coated with a 5% sodium silicate solution and excess solution was doctored off. One plate "C" was baked for 15 seconds at 150 degrees C., while the other plate "D" was not so baked. Both plates were then rinsed and dried and subjected to a zincate test. Plate C produced a zincate reading of 85 whereas plate D produced a zincate reading of 57 indicating that plate C demonstrated superior protecting and bonding characteristics over the control plate D.

Although the invention has been described by reference to some preferred embodiments it is not intended that the invention be limited thereby but that modifications thereof are intended to be included within the spirit and broad scope of the foregoing disclosure and the following claims.

We claim:

1. A method of producing a lithographic printing plate which comprises applying an aqueous bonding coating solution wherein the solute of the aqueous coating solution is a substance selected from the group consisting of an alkali silicate, silicic acid, alkali zirconium fluoride, hydrofluozirconic acid, Group IV-B metal fluoride, polyacrylic acid, alkali metal salt and alkali metal acid, to at least one surface of an aluminum sheet substrate suitable as a base for lithographic printing plates, removing excess bonding solution, thereafter subjecting the coated aluminum sheet substrate to a hot air baking treatment at elevated temperatures in the range of from about 50 degrees C. to about 300 degrees C. then removing any excess coating solution which has not reacted with the aluminum sheet substrate, and applying a suitable light sensitive lithographic composition to the coated aluminum sheet substrate.

2. The method of claim 1 where the light sensitive lithographic compound is a diazo compound.

3. The lithographic printing plate obtained by the method of claim 1.

4. The method of claim 1 where the surface of the aluminum material has been anodized.

5. The method of claim 1 where the coated substrate is subjected to an elevated temperature in the range of 50 degrees C. to 300 degrees C. for a period of from 5 seconds to 120 seconds.

6. The method of claim 1 wherein the solute concentration is from 0.5% to 20% by volume of total solution.

7. The method of claim 1 wherein the coating solution comprises sodium silicate.

8. The method of claim 1 wherein the coating solution comprises potassium zirconium hexafluoride.

9. The lithographic printing plate produced by the method of claim 2.

10. The lithographic printing plate produced by the method of claim 4.

11. The lithographic printing plate produced by the method of claim 5.

12. The lithographic printing plate produced by the method of claim 6.

13. The lithographic printing plate produced by the method of claim 7.

14. The lithographic printing plate produced by the method of claim 8.

15. The method of claim 5 wherein the solute of the aqueous coating solution is sodium silicate or potassium zirconium fluoride and the light sensitive lithographic composition comprises a diazo composition.

16. The lithographic printing plate produced by the method of claim 15.

* * * * *